US009855486B2

(12) United States Patent
Shupe et al.

(10) Patent No.: US 9,855,486 B2
(45) Date of Patent: Jan. 2, 2018

(54) PROTECTIVE BASEBALL SLIDING GLOVE

(71) Applicants: Gerda Shupe, Yountville, CA (US); Brodie Ross Penquite, Lomond, CA (US)

(72) Inventors: Gerda Shupe, Yountville, CA (US); Brodie Ross Penquite, Lomond, CA (US)

( * ) Notice: Subject to any disclaimer, the term of this patent is extended or adjusted under 35 U.S.C. 154(b) by 76 days.

(21) Appl. No.: 15/002,442

(22) Filed: Jan. 21, 2016

(65) Prior Publication Data

US 2016/0220888 A1 Aug. 4, 2016

Related U.S. Application Data

(60) Provisional application No. 62/109,221, filed on Jan. 29, 2015.

(51) Int. Cl.

| | |
|---|---|
| ***A63B 71/00*** | (2006.01) |
| ***A63B 71/14*** | (2006.01) |
| ***A41D 19/015*** | (2006.01) |
| ***A41D 19/00*** | (2006.01) |
| *A63B 102/18* | (2015.01) |

(52) U.S. Cl.

CPC ..... *A63B 71/143* (2013.01); *A41D 19/0048* (2013.01); *A41D 19/01505* (2013.01); *A41D 19/01511* (2013.01); *A41D 19/01517* (2013.01); *A41D 19/01588* (2013.01); *A41D 2300/32* (2013.01); *A63B 2102/18* (2015.10); *A63B 2209/10* (2013.01); *A63B 2225/09* (2013.01)

(58) Field of Classification Search

CPC ..... A63B 71/143; A41D 19/01505; A41D 19/01511; A41D 19/01517; A41D 19/01588; A41D 19/0048; A41D 2300/32

See application file for complete search history.

(56) References Cited

U.S. PATENT DOCUMENTS

| | | | | | |
|---|---|---|---|---|---|
| 3,576,036 | A * | 4/1971 | Latina | A63B 71/143 | 2/19 |
| 3,855,633 | A * | 12/1974 | Rhee | A63B 71/14 | 2/161.1 |
| 4,272,849 | A * | 6/1981 | Thurston | A41D 19/01517 | 2/16 |
| 5,349,966 | A * | 9/1994 | Garcia | A61F 5/37 | 128/879 |
| 5,375,263 | A * | 12/1994 | Cuccia | A41D 19/01 | 2/158 |
| 5,402,537 | A * | 4/1995 | Kolada | A63B 71/143 | 2/161.1 |

(Continued)

*Primary Examiner* — Khaled Annis

(57) ABSTRACT

A protective baseball sliding glove is a device for protecting the user's hand when the user is sliding into a base. The user is able to position his or her hand within a hand-enclosing rigid housing that is then placed into a glove that covers the hand-enclosing rigid housing and a portion of the user's forearm. The user is able to grasp a cross-brace within the hand-enclosing rigid housing, anchoring the user's hand within the hand-enclosing rigid housing. The position of the cross-brace may be adjusted via a plurality of adjustment holes on the hand-enclosing rigid housing that allows the user to move the cross-brace to his or her comfort. A securing stabilizer strap may be utilized to secure the glove as well as provide structural support and rigidity to the user's wrist.

15 Claims, 7 Drawing Sheets

(56) References Cited

U.S. PATENT DOCUMENTS

| | | | | | |
|---|---|---|---|---|---|
| 5,572,739 | A * | 11/1996 | Kolada | A63B 71/143 | 2/161.1 |
| 5,687,421 | A * | 11/1997 | Murai | A63B 71/143 | 150/154 |
| 5,745,916 | A * | 5/1998 | Linner | A63B 71/143 | 2/16 |
| 6,681,401 | B1 * | 1/2004 | Marino | A63B 71/143 | 2/19 |
| 2002/0073477 | A1 * | 6/2002 | Hochmuth | A41D 19/015 | 2/161.1 |
| 2008/0052799 | A1 * | 3/2008 | Yoo | A41D 19/01505 | 2/16 |
| 2008/0250540 | A1 * | 10/2008 | Aoki | A63B 71/143 | 2/19 |
| 2008/0313786 | A1 * | 12/2008 | Saturnio | A41D 19/01588 | 2/16 |
| 2009/0172864 | A1 * | 7/2009 | Fisher | A41D 19/01588 | 2/161.1 |
| 2012/0052968 | A1 * | 3/2012 | Basden | A41D 19/01588 | 473/205 |

* cited by examiner

SECTION A-A

PROTECTIVE BASEBALL SLIDING GLOVE

The current application claims a priority to the U.S. Provisional Patent application Ser. No. 62/109,221 filed on Jan. 29, 2015.

FIELD OF THE INVENTION

The present invention relates generally to protective sportswear. More specifically, the present invention is a protective baseball sliding glove that protects the user's hand when sliding into a base.

BACKGROUND OF THE INVENTION

In the sport of baseball, base running is an essential part of a player's skillset. Base running is such an important skill that oftentimes players are particularly valued for their base running abilities when base stealing and when advancing bases during a play. One of the facets of base running that must be mastered in order to be an effective baserunner is sliding. While there are many variants for sliding into a base, slides are generally initiated head first or feet first. A baserunner may attempt a slide for a number of reasons including trying to avoid a tag out by a defensive player. This is generally accomplished by attempting to position the body as far from the defensive player as possible while still making contact with the base. A slide may also be used to hinder a defensive play (such as a double play) by disrupting the defensive player's movement and actions during the play. While slides may be effective for avoiding a tag out or for disrupting a defensive play, slides are not without the threat of injury to the baserunner, particularly when sliding head first. When sliding head first, the baserunner's hand is extended toward the base and is vulnerable. It is possible for the baserunner to injure a hand for a number of reasons such as being stepped on by the spiked shoes of the defensive player. The risk of injury is exacerbated by the fact that batters and baserunners generally do not wear protective gear for the hands.

The present invention is a protective baseball sliding glove that protects the user's hand when the user is sliding head first into a base. The present invention protects the user's hand from being stepped on or otherwise harmed as the user attempts to make contact with a base while sliding.

DETAIL DESCRIPTIONS OF THE INVENTION

All illustrations of the drawings are for the purpose of describing selected versions of the present invention and are not intended to limit the scope of the present invention.

Figure 1:
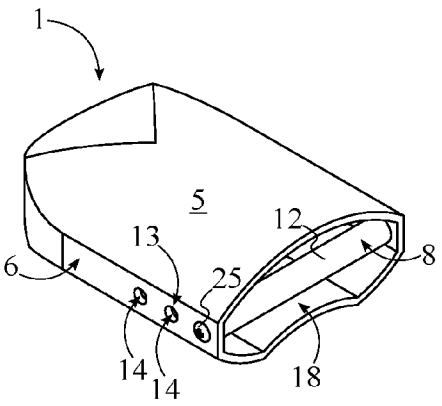
FIG. 1 is a left side rear perspective view of the present invention.
Figure 1:
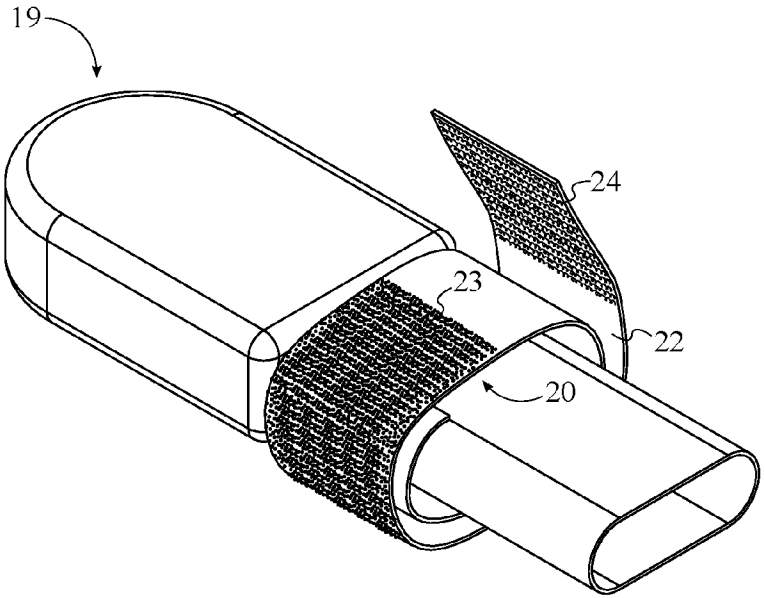
Figure 2:
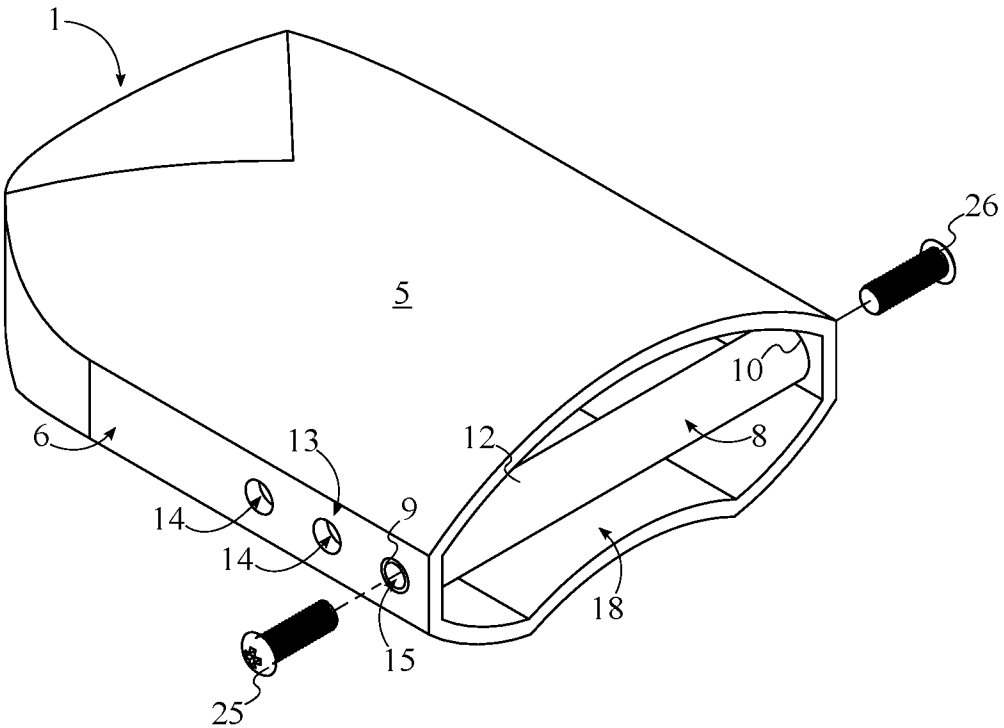
FIG. 2 is a left side rear perspective view of the hand-enclosing rigid housing.
Figure 3:
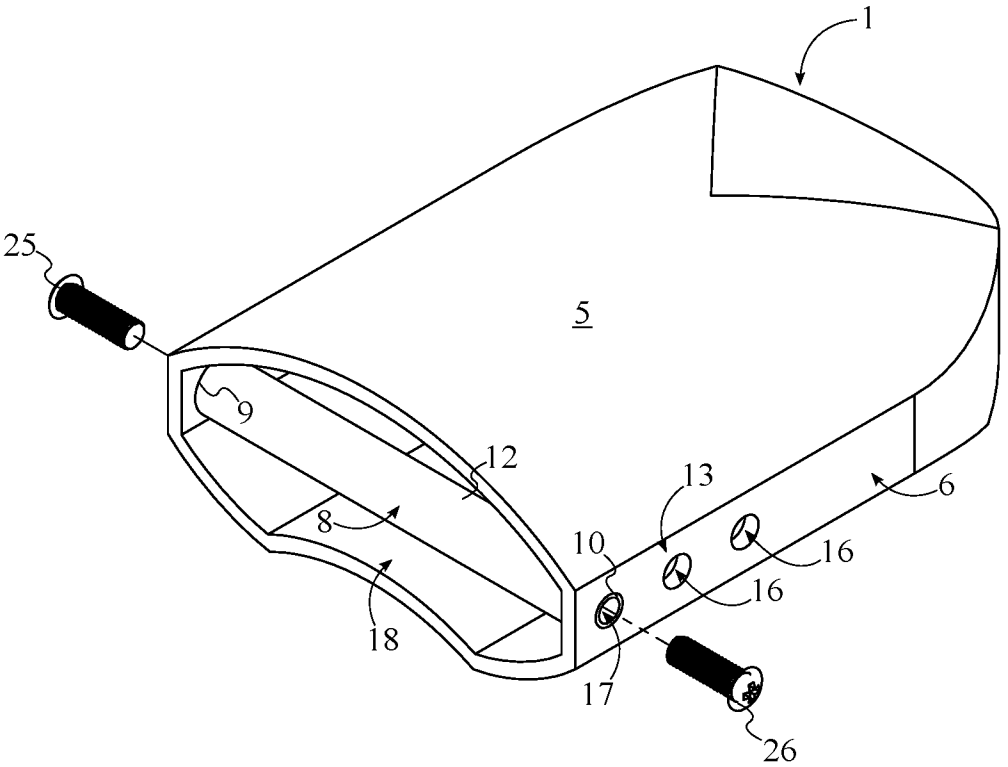
FIG. 3 is a right side rear perspective view of the hand-enclosing rigid housing.
Figure 4:
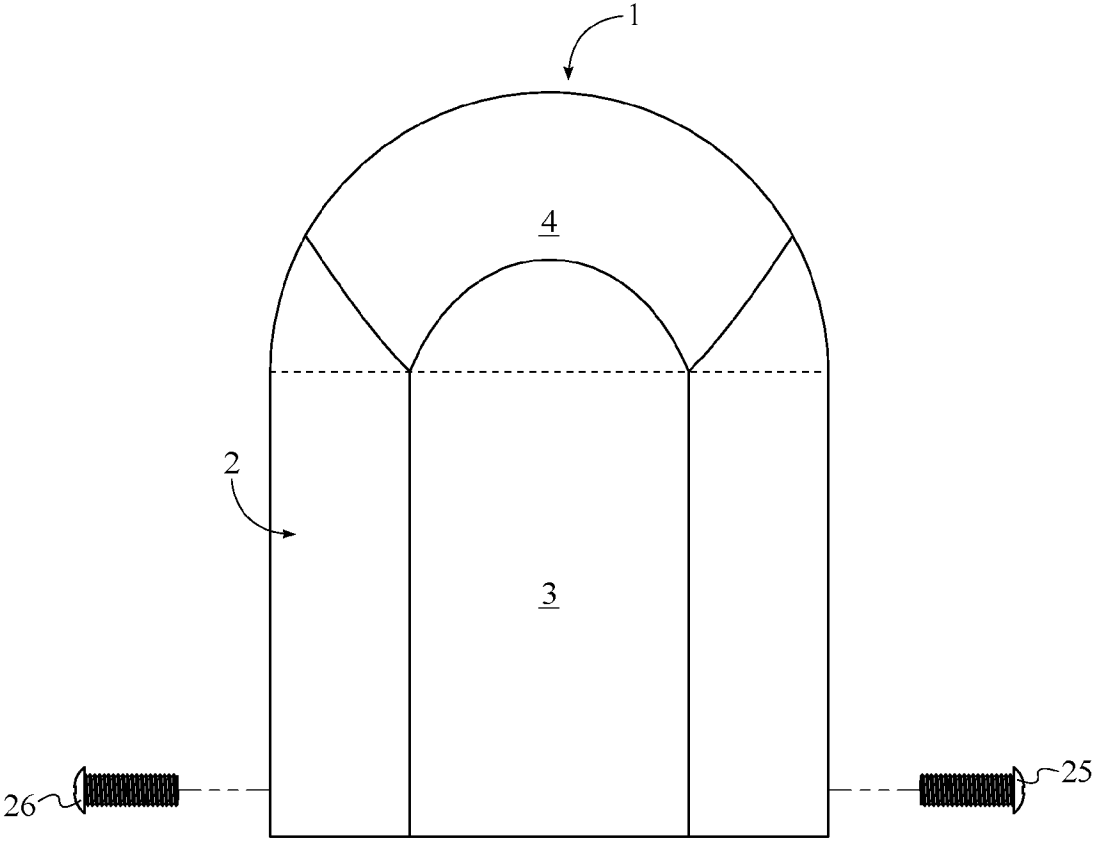
FIG. 4 is a bottom view of the hand-enclosing rigid housing.
Figure 5:
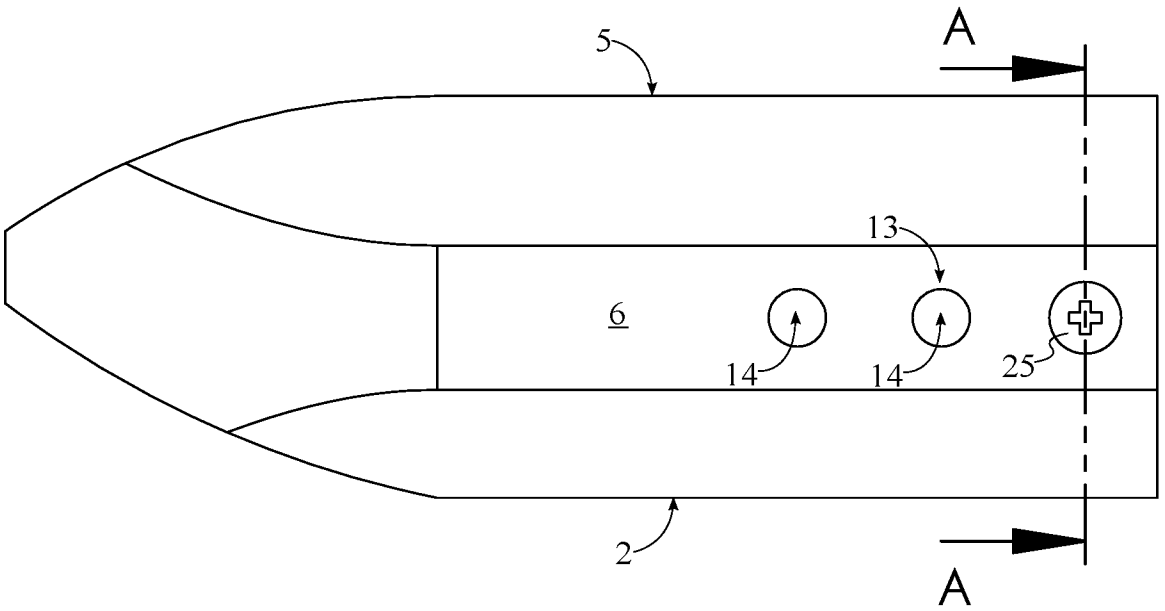
FIG. 5 is a left side view of the hand-enclosing rigid housing.
Figure 6:
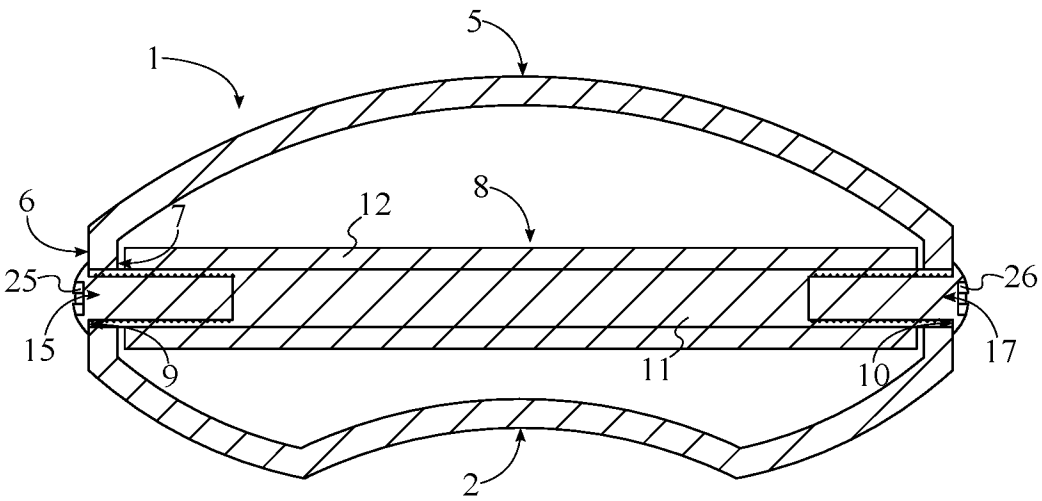
FIG. 6 is a cross-sectional view of the hand-enclosing rigid housing taken along line A-A of FIG. 5.

The present invention is a protective baseball sliding glove that is designed to protect the user's hand while the user is sliding into a base. The present invention is shown in FIG. 1 and comprises a hand-enclosing rigid housing 1, a cross-brace 8, a plurality of adjustment holes 13, a hand opening 18, and a glove 19.

With reference to FIGS. 2-6, the hand-enclosing rigid housing 1 is a hollow protective shell that prevents the user's hand from being crushed by a baseman who is attempting to tag the user out during a play. The hand-enclosing rigid housing 1 comprises a front portion 2, a rear portion 5, an external lateral surface 6, and an internal lateral surface 7. The front portion 2 and the rear portion 5 are positioned opposite to each other about the hand-enclosing rigid housing 1 and are thus opposing surfaces of the hand-enclosing rigid housing 1. The front portion 2 is the portion of the hand-enclosing rigid housing 1 that faces the user's palm while the rear portion 5 is the portion of the hand-enclosing rigid housing 1 that faces the back of the user's hand. The external lateral surface 6 and the internal lateral surface 7 form a flat surface in between the front portion 2 and the rear portion 5 on which the plurality of adjustment holes 13 is located.

The cross-brace 8 is an elongated member that the user is able to grasp while the present invention is in use. The cross-brace 8 enables the user's hand to be secured within the hand-enclosing rigid housing 1 when the user grasps and holds onto the cross-brace 8. In the preferred embodiment of the present invention, the cross-brace 8 comprises a grasping rod 11 and a cylindrical pad 12. The grasping rod 11 is a cylindrical member that may be grasped and held by the user during use of the present invention. The cylindrical pad 12 serves to improve user comfort while the user is holding onto the grasping rod 11. The grasping rod 11 is sheathed by the cylindrical pad 12, enabling the cylindrical pad 12 to cover the length of the grasping rod 11. The plurality of adjustment holes 13 is able to hold the cross-brace 8 in place within the hand-enclosing rigid housing 1 and additionally allows the position of the cross-brace 8 to be adjusted as well based on the user's preferences. The plurality of adjustment holes 13 traverses through the external lateral surface 6 and the internal lateral surface 7, enabling the cross-brace 8 to be inserted through and held in place within the plurality of adjustment holes 13.

The hand opening 18 is a hole through which the user is able to insert his or her hand into the hand-enclosing rigid housing 1. The hand opening 18 traverses into the hand-enclosing rigid housing 1, parallel to the front portion 2 and the rear portion 5. The user is thus able to insert his or her hand into the hand-enclosing rigid housing 1 in a manner such that the user's palm is oriented toward the front portion 2 and the back of the user's hand is oriented toward the rear portion 5.

As shown in FIG. 1, the glove 19 is a garment that is worn over the hand-enclosing rigid housing 1 during use of the present invention. The hand-enclosing rigid housing 1 is enclosed within the glove 19, enabling the glove 19 to cover the hand-enclosing rigid housing 1 and a portion of the user's forearm. The glove 19 extends up a portion of the user's forearm and provides protection to the user's forearm while sliding.

Figure 7:
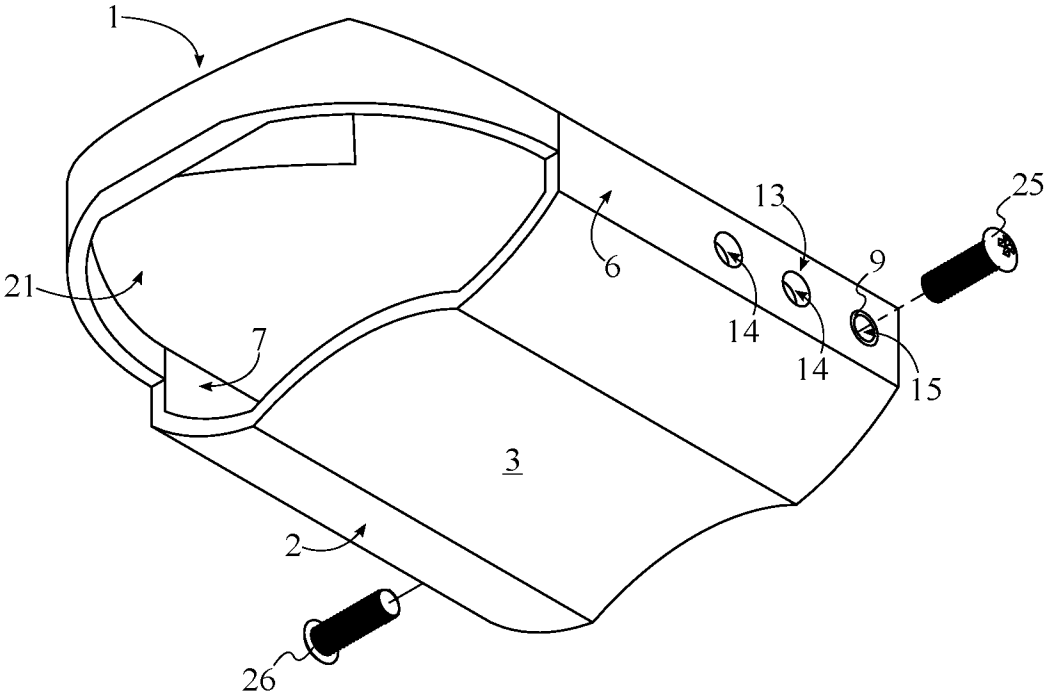
FIG. 7 is a left side front perspective view of an embodiment of the hand-enclosing rigid housing with the finger access slot.

In the embodiment of the present invention shown in FIG. 7, the present invention further comprises a finger access slot 21. The finger access slot 21 allows the user's fingers to protrude from within the hand-enclosing rigid housing 1. This aids the user in performing actions such as grabbing onto a base while sliding during the course of a play. The front portion 2 comprises a palm section 3 and a finger section 4 and the palm section 3 is positioned adjacent to the finger section 4. The palm section 3 corresponds to the user's palm in between the wrist and the fingers. The finger section 4 corresponds to the user's fingers. The finger access slot 21 traverses through the hand-enclosing rigid housing 1 from the front portion 2 up to the rear portion 5. This ensures that the user's fingers are protected from being crushed while allowing the user's fingers to protrude outward from within the hand-enclosing rigid housing 1 in a manner such that the user may grab onto a bag while sliding. The finger access slot 21 traverses through the hand-enclosing rigid housing 1 from the finger section 4 towards the palm section 3. The user's palm is thus protected within the hand-enclosing rigid housing 1 and does not come into contact with the surface upon which the user is sliding. The finger access slot 21 thus permits the user's fingers to protrude from within the hand-enclosing rigid housing 1 while protecting the user's palm.

Again with reference to FIGS. 2-6, in the preferred embodiment of the present invention, the plurality of adjustment holes 13 comprises a first plurality of adjustment holes 14 and a second plurality of adjustment holes 16. The first plurality of adjustment holes 14 and the second plurality of adjustment holes 16 are utilized to hold a first end 9 and a second end 10 of the cross-brace 8 in place within the hand-enclosing rigid housing 1. The first plurality of adjustment holes 14 and the second plurality of adjustment holes 16 are positioned opposite to each other about the hand-enclosing rigid housing 1. The first plurality of adjustment holes 14 and the second plurality of adjustment holes 16 are thus offset from each other and are able to hold the cross-brace 8 in place at two positions. The first plurality of adjustment holes 14 is oriented parallel to the second plurality of adjustment holes 16. Each hole from the first plurality of adjustment holes 14 is thus aligned with a corresponding hole from the second plurality of adjustment holes 16 in order to ensure that the cross-brace 8 is aligned properly within the hand-enclosing rigid housing 1. The first end 9 is removably engaged into a first selected hole 15 from the first plurality of adjustment holes 14 while the second end 10 is removably engaged into a second selected hole 17 from the second plurality of adjustment holes 16. The cross-brace 8 may then be secured in place within the first selected hole 15 and the second selected hole 17 via fasteners or a similar mechanism. The cross-brace 8 is removable from the first selected hole 15 and the second selected hole 17 in order to allow positional adjustment of the cross-brace 8 within the hand-enclosing rigid housing 1. The position of the cross-brace 8 is adjusted according to the preferences of the user in order to suit the user's specific hand. In the preferred embodiment of the present invention, the cross-brace 8 is positioned in a manner such that the user may fully extend his or her fingers within the hand-enclosing rigid housing 1 when the user's thumb is positioned below the cross-brace 8 and the user's palm is positioned above the cross-brace 8.

In the preferred embodiment of the present invention, the cross-brace 8 is held in place within the first selected hole 15 and the second selected hole 16 via a first fastener 25 and a second fastener 26. The first fastener 25 is removably engaged into the first end 9 while the second fastener 26 is removably engaged into the second end 10. The first fastener 25 and the second fastener 26 are thus able to prevent the cross-brace 8 from dislodging during use of the present invention and may be removed as needed when adjusting the position of the cross-brace 8.

Again with reference to FIG. 1, the present invention further comprises a securing stabilizer strap 22. The securing stabilizer strap 22 is utilized to both secure the glove 19 in place on the user's hand and forearm as well as to provide structural support and rigidity to the user's wrist when the user is sliding into a base. The securing stabilizer strap 22 is adjacently connected to a wrist section 20 of the glove 19. The securing stabilizer strap 22 may thus be wrapped multiple times around the user's wrist to secure the glove 19 in place and to provide rigidity to the user's wrist. The securing stabilizer strap 22 is preferably of a sufficient length to enable the securing stabilizer strap 22 to be wrapped multiple times around the user's wrist when securing the glove 19.

With further reference to FIG. 1, in its preferred embodiment, the present invention further comprises a plurality of hook fasteners 23 and a plurality of loop fasteners 24. The plurality of hook fasteners 23 and the plurality of loop fasteners 24 function as a securing mechanism and are utilized to secure the securing stabilizer strap 22 in place on the glove 19 when the present invention is in use. The plurality of hook fasteners 23 and the plurality of loop fasteners 24 are positioned on a wrist section 20 of the securing stabilizer strap 22 to allow the securing stabilizer strap 22 to be secured to itself. The securing stabilizer strap 22 may thus be wrapped around the wrist section 20 to provide support to the user's wrist and held in place by affixing the plurality of hook fasteners 23 to the plurality of loop fasteners 24. The plurality of loop fasteners 24 is offset from the plurality of hook fasteners 23 along the securing stabilizer strap 22 to allow the securing stabilizer strap 22 to be wrapped around the wrist section 20 and then secured to itself. The plurality of hook fasteners 23 is removably engaged to the plurality of loop fasteners 24 to allow the securing stabilizer strap 22 to undo the securing mechanism when the user wishes to remove the glove 19.

Although the present invention has been explained in relation to its preferred embodiment, it is understood that many other possible modifications and variations can be made without departing from the spirit and scope of the present invention as hereinafter claimed.

What is claimed is:

1. A protective baseball sliding glove system comprising:

a hand-enclosing rigid housing;

a cross-brace;

a plurality of adjustment holes;

a hand opening;

a glove;

the hand-enclosing rigid housing comprising a front portion, a rear portion, an external lateral surface, and an internal lateral surface;

the front portion and the rear portion being positioned opposite to each other along the hand-enclosing rigid housing;

the cross-brace being removably engaged into the plurality of adjustment holes;

the plurality of adjustment holes traversing through the external lateral surface and the internal lateral surface;

the hand opening traversing into the hand-enclosing rigid housing, parallel to the front portion and the rear portion;

the hand-enclosing rigid housing being enclosed within the glove;

the cross-brace comprising a grasping rod and a cylindrical pad; and the grasping rod being sheathed by the cylindrical pad.

2. The protective baseball sliding glove system as claimed in claim 1 comprising:

a finger access slot;

the front portion comprising a palm section and a finger section;

the palm section being positioned adjacent to the finger section;

the finger access slot traversing through the hand-enclosing rigid housing from the front portion up to the rear portion; and the finger access slot traversing through the hand-enclosing rigid housing from the finger section towards the palm section.

3. The protective baseball sliding glove system as claimed in claim 1 comprising:

the plurality of adjustment holes comprising a first plurality of adjustment holes and a second plurality of adjustment holes;

the first plurality of adjustment holes and the second plurality of adjustment holes being positioned opposite to each other along the hand-enclosing rigid housing;

the first plurality of adjustment holes being oriented parallel to the second plurality of adjustment holes;

a first end of the cross-brace being removably engaged into a first selected hole from the first plurality of adjustment holes; and a second end of the cross-brace being removably engaged into a second selected hole from the second plurality of adjustment holes.

4. The protective baseball sliding glove system as claimed in claim 3 comprising:

a first fastener;

a second fastener;

the first fastener being removably engaged into the first end; and the second fastener being removably engaged into the second end.

5. The protective baseball sliding glove system as claimed in claim 1 comprising:

a securing stabilizer strap; and the securing stabilizer strap being adjacently connected to a wrist section of the glove.

6. The protective baseball sliding glove system as claimed in claim 5 comprising:

a plurality of hook fasteners;

a plurality of loop fasteners;

the plurality of hook fasteners and the plurality of hook fasteners being positioned on a wrist section of the securing stabilizer strap;

the plurality of loop fasteners being offset from the plurality of hook fasteners along the securing stabilizer strap; and the plurality of hook fasteners being removably engaged to the plurality of loop fasteners.

7. A protective baseball sliding glove system comprising:

a hand-enclosing rigid housing;

a cross-brace;

a plurality of adjustment holes;

a hand opening;

a glove;

a securing stabilizer strap;

the hand-enclosing rigid housing comprising a front portion, a rear portion, an external lateral surface, and an internal lateral surface;

the front portion and the rear portion being positioned opposite to each other along the hand-enclosing rigid housing;

the cross-brace being removably engaged into the plurality of adjustment holes;

the plurality of adjustment holes traversing through the external lateral surface and the internal lateral surface;

the hand opening traversing into the hand-enclosing rigid housing, parallel to the front portion and the rear portion;

the hand-enclosing rigid housing being enclosed within the glove;

the securing stabilizer strap being adjacently connected to a wrist section of the glove;

the cross-brace comprising a grasping rod and a cylindrical pad; and the grasping rod being sheathed by the cylindrical pad.

8. The protective baseball sliding glove system as claimed in claim 7 comprising:

a finger access slot;

the front portion comprising a palm section and a finger section;

the palm section being positioned adjacent to the finger section;

the finger access slot traversing through the hand-enclosing rigid housing from the front portion up to the rear portion; and the finger access slot traversing through the hand-enclosing rigid housing from the finger section towards the palm section.

9. The protective baseball sliding glove system as claimed in claim 7 comprising:

the plurality of adjustment holes comprising a first plurality of adjustment holes and a second plurality of adjustment holes;

the first plurality of adjustment holes and the second plurality of adjustment holes being positioned opposite to each other along the hand-enclosing rigid housing;

the first plurality of adjustment holes being oriented parallel to the second plurality of adjustment holes;

a first end of the cross-brace being removably engaged into a first selected hole from the first plurality of adjustment holes; and a second end of the cross-brace being removably engaged into a second selected hole from the second plurality of adjustment holes.

10. The protective baseball sliding glove system as claimed in claim 9 comprising:

a first fastener;

a second fastener;

the first fastener being removably engaged into the first end; and the second fastener being removably engaged into the second end.

11. The protective baseball sliding glove system as claimed in claim 7 comprising:

a plurality of hook fasteners;

a plurality of loop fasteners;

the plurality of hook fasteners and the plurality of hook fasteners being positioned on a wrist section of the securing stabilizer strap;

the plurality of loop fasteners being offset from the plurality of hook fasteners along the securing stabilizer strap; and the plurality of hook fasteners being removably engaged to the plurality of loop fasteners.

12. A protective baseball sliding glove system comprising:

a hand-enclosing rigid housing;

a cross-brace;

a plurality of adjustment holes;

a hand opening;

a glove;

a securing stabilizer strap;

the hand-enclosing rigid housing comprising a front portion, a rear portion, an external lateral surface, and an internal lateral surface;

the plurality of adjustment holes comprising a first plurality of adjustment holes and a second plurality of adjustment holes;

the front portion and the rear portion being positioned opposite to each other along the hand-enclosing rigid housing;

the cross-brace being removably engaged into the plurality of adjustment holes;

the plurality of adjustment holes traversing through the external lateral surface and the internal lateral surface;

the hand opening traversing into the hand-enclosing rigid housing, parallel to the front portion and the rear portion;

the hand-enclosing rigid housing being enclosed within the glove;

the securing stabilizer strap being adjacently connected to a wrist section of the glove;

the first plurality of adjustment holes and the second plurality of adjustment holes being positioned opposite to each other along the hand-enclosing rigid housing;

the first plurality of adjustment holes being oriented parallel to the second plurality of adjustment holes;

a first end of the cross-brace being removably engaged into a first selected hole from the first plurality of adjustment holes;

a second end of the cross-brace being removably engaged into a second selected hole from the second plurality of adjustment holes;

the cross-brace comprising a grasping rod and a cylindrical pad; and the grasping rod being sheathed by the cylindrical pad.

13. The protective baseball sliding glove system as claimed in claim 12 comprising:

a finger access slot;

the front portion comprising a palm section and a finger section;

the palm section being positioned adjacent to the finger section;

the finger access slot traversing through the hand-enclosing rigid housing from the front portion up to the rear portion; and the finger access slot traversing through the hand-enclosing rigid housing from the finger section towards the palm section.

14. The protective baseball sliding glove system as claimed in claim 12 comprising:

a first fastener;

a second fastener;

the first fastener being removably engaged into the first end; and the second fastener being removably engaged into the second end.

15. The protective baseball sliding glove system as claimed in claim 12 comprising:

a plurality of hook fasteners;

a plurality of loop fasteners;

the plurality of hook fasteners and the plurality of hook fasteners being positioned on a wrist section of the securing stabilizer strap;

the plurality of loop fasteners being offset from the plurality of hook fasteners along the securing stabilizer strap; and the plurality of hook fasteners being removably engaged to the plurality of loop fasteners.

* * * * *